United States Patent [19]

Zeller

[11] 4,432,042

[45] Feb. 14, 1984

[54] PORTABLE BOOK LIGHT

[76] Inventor: Noel E. Zeller, 7 Brentwood Ave., White Plains, N.Y. 10605

[21] Appl. No.: 469,786

[22] Filed: Feb. 25, 1983

[51] Int. Cl.[3] ..... F21L 7/00

[52] U.S. Cl. ..... 362/183; 362/98; 362/99; 362/186; 362/187; 362/188; 362/189; 362/190; 362/191; 362/197; 362/198; 362/199; 362/269; 362/275; 362/280; 362/285; 362/287; 362/368; 362/419; 362/427; 362/430; 362/431

[58] Field of Search ..... 362/98, 99, 183, 186, 362/187, 188, 189, 190, 191, 197, 198, 199, 269, 275, 280, 285, 287, 368, 419, 427, 430, 431

[56] References Cited

U.S. PATENT DOCUMENTS 1,010,335 11/1911 Williams ..... 362/98

2,614,204 10/1952 Canfield ..... 362/98

3,381,122 4/1968 Boyle ..... 362/99

*Primary Examiner*—Stephen J. Lechert, Jr.

*Attorney, Agent, or Firm*—Bierman, Bierman & Peroff

[57] ABSTRACT

A book-light characterized by its small size and light weight is formed from suitable plastic material with a base supporting a vertical lamp-bearing arm and an integral clamp consisting of a U-shaped frame having side arms rigidly attached to the base and a central plate flexibly attached to the base so that the entire book-light may be attached to a book or other publication by inserting the cover or pages between arms and the central plate. The vertical lamp-bearing arm is mounted at one end in a transverse slot in the base, while the other end supports the lamp proper in a manner to permit both circular and vertical motions.

12 Claims, 6 Drawing Figures

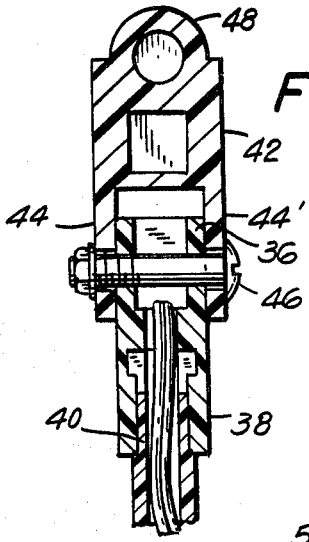
FIG. 5
FIG. 4
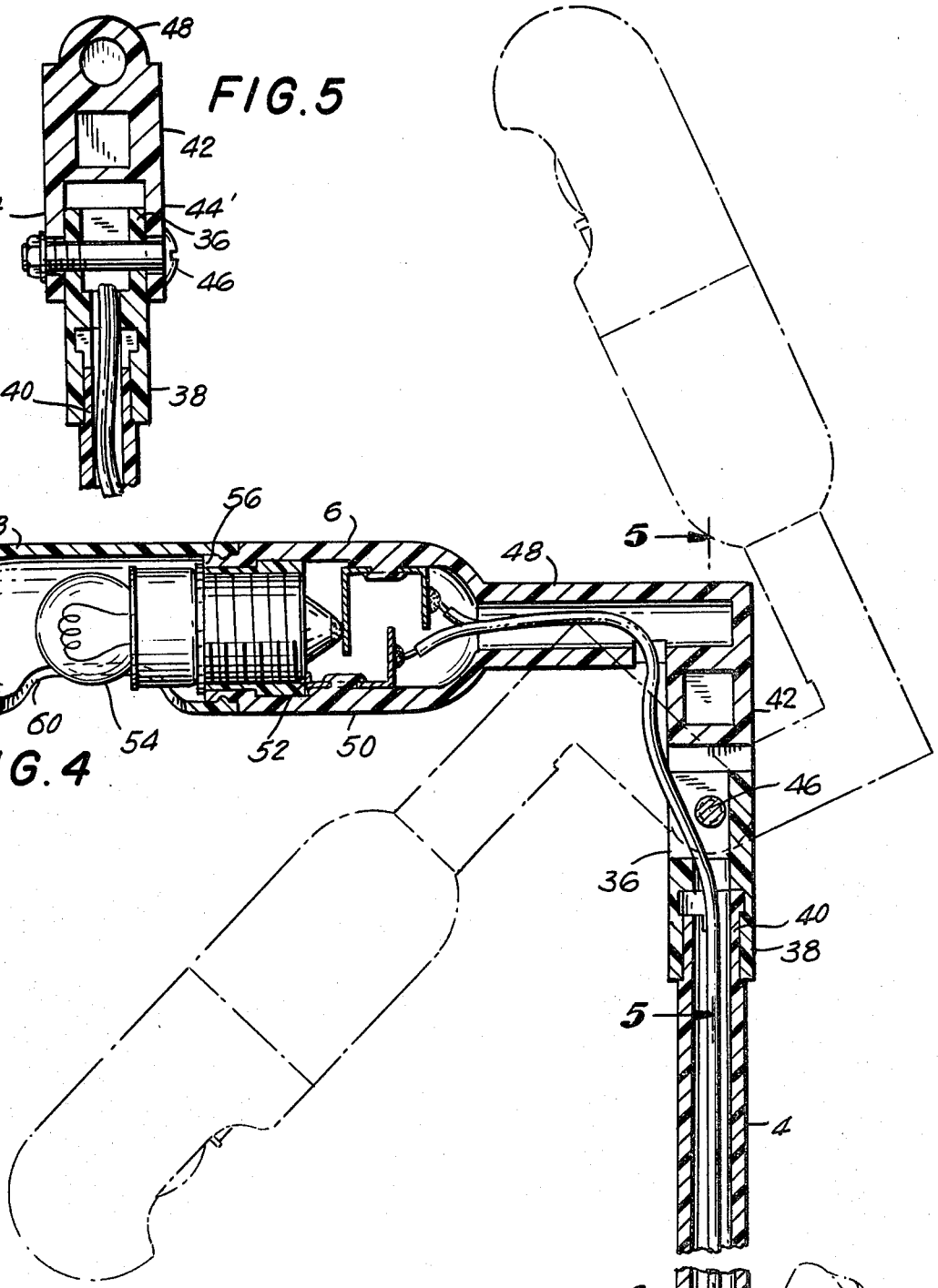
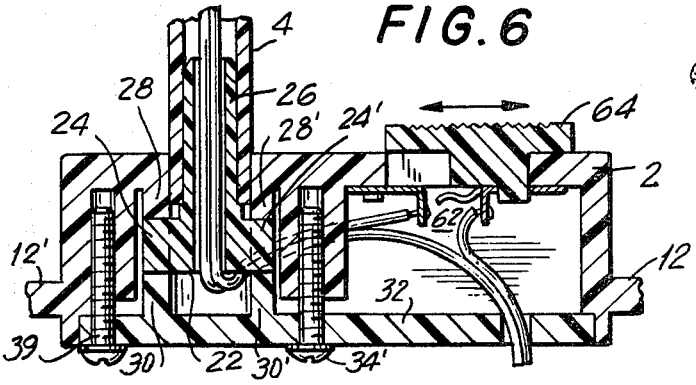
FIG. 6
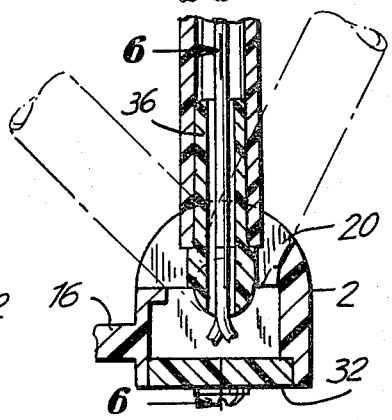

PORTABLE BOOK LIGHT

This invention relates to a portable book-light and more particularly to such a light which can be readily supported by the pages or cover of a book and is of such light weight that it will not add appreciably to the weight of the book. The light itself can be adjustable to almost any position to suit the reader and the manner in which the book is to be held.

Book-lights of various type are, of course, known in the prior art. Some of these lights, of standard size, are adapted to be clamped or otherwise supported by a stand or by the headrest of a bed. While some can be clamped to a book, they generally add such size and weight to the latter that they become tiring to the reader.

It is, therefore, an object of this invention to provide a simple portable, readily attachable lightweight book-light which avoids the disadvantages of prior art structures.

Another object of this invention is to provide a book-light having the advantages above mentioned which incorporate a readily available switch on the base of the book-light.

An additional object of the invention is to provide a book-light in which the lamp thereof is not only shaded from the eyes of the reader, but can be turned circularly and vertically to provide a combination of motions which permit the reader to adjust the direction of the light so that light may fall upon the book in an optimum manner despite changes in position of either the book or the reader or both.

The above and other objects and advantages of the invention will become apparent from the description which follows, read with reference to the attached drawings in which FIG. 1 is a fanciful drawing showing the manner in which the book-light of the present invention is intended to be used.

FIG. 4 is an enlarged vertical cross-sectional view of the book-light taken along the line 4—4 of FIG. 2;

FIG. 5 is a vertical cross-sectional view taken along the line 5—5 of FIG. 4; and FIG. 6 is a vertical cross-sectional view through the base of the book-light taken along the line 6—6 of FIG. 4.

Figure 1:
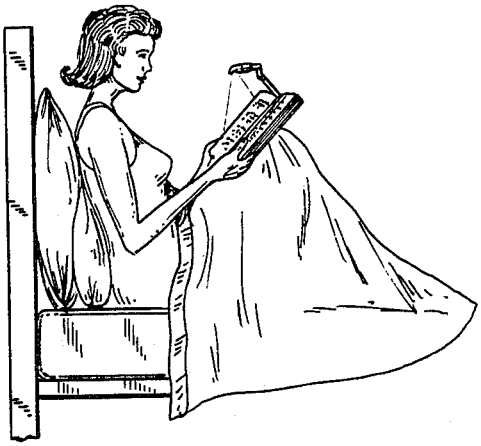
Figure 2:
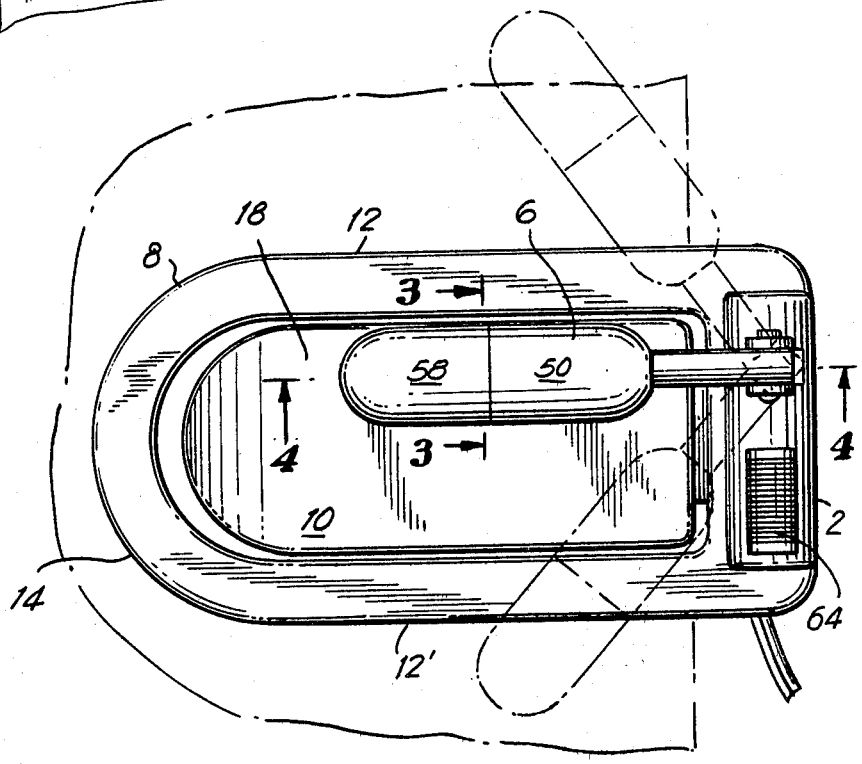
FIG. 2 is a top plan view of the book-light.
Figure 3:
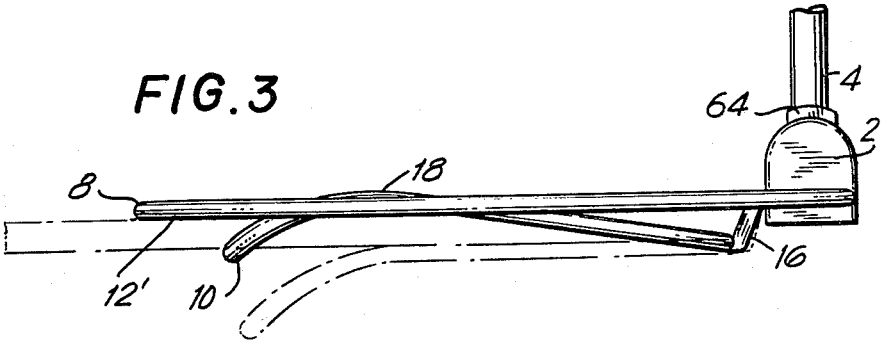
FIG. 3 is a side view of the bottom of the book-light shown in FIG. 2.

As will be apparent from a study of FIGS. 2 and 3, the essential elements of the book-light comprise a base member consisting of a capsule 2 from which projects upwardly a tubular arm 4 for supporting lamp 6 in a manner to be described hereinafter, and means for attaching capsule 2 bearing lamp 6 to a book, magazine or the like comprising a clamp formed of an upper two-armed member 8 rigidly attached, preferably as an integral piece with capsule 2 and a lower somewhat tongue-shaped plate 10 fitting within member 8 and flexibly attached at one end to capsule 2. More specifically, member 8 has arms 12 and 12' integrally attached at one end to capsule 2 and preferably but not necessarily connected together at their other end by arcuate portion 14. This is a rigid construction which may be molded as one piece of appropriate plastic with the capsule. Plate 10, on the other hand, is flexibly attached to the capsule at 16 and is formed with a raised bow portion 18 which in its normal position may extend slightly above member 8 as more clearly shown in FIG. 3. The dimensions of member 8 and plate 10 are such that they provide a sufficient gripping surface to clamp between them a number of pages or the cover of a book or other document so that the book-light in essence becomes self-supporting upon the object to which light is to be directed.

Tubular arm 4 extends upwardly from capsule 2, being mounted for transverse rotation in a transverse slot at one end of the top thereof. As shown in FIGS. 4 and 6, the means for rotatably supporting the lower end of tubular arm 4 preferably consists of a support 22 in the form of an inverted T, the arms 24 and 24' of which are cylindrically formed and whose upright stem 26 is force fit within the tubular arm. The bearing for cylindrical arms 24 and 24' is formed by internal downwardly extending integral projections 28 and 28' within capsule 2 and upwardly extending projections 30 and 30' from a base plate 32 attached to the capsule on either side of the bearing by screws 34 and 34'. It will be noted that the threaded openings for these screws are of somewhat greater depth than the length of the said screws. This permits the screws to be tightened (or loosened) in an adjustable manner to vary pressure on arms 24, 24' through projections 30, 30'. This is possible because base plate 32 is thin and sufficiently flexible. Accordingly, this arrangement is such that sufficient pressure may be placed upon the bearing so that arm 4 can be moved at will, but will always remain at any desired angular position.

Lamp 6 is attached to the top of tubular arm 4 in a manner to permit both circular and vertical movement relative to capsule 2. As shown in FIGS. 4 and 5, this is effected first of all by a small supporting member 36 having a downwardly extending tubular extension 38 fitting over a preferably smaller end 40 of tubular arm 4. The parts are so dimensioned that being formed of suitable plastic, member 36 is attached to arm 4 with a force fit which at the same time permits member 36 to fully rotate on top of the arm.

A bracket-shaped piece 42 is provided with a pair of arms 44 and 44' pivotally attached as by threaded screw 46 to supporting member 36. Bracket piece 42 has an integral right-angled hollow extension 48 which is enlarged at its outer end to form a cylinder 50 in which a lamp socket 52 (and attendant connector pieces) both of any conventional form, are mounted. The outer end of cylinder 50 is open to permit insertion of light bulb 54 and is formed with a slightly smaller diameter, as at 56, so that a shade 58 of generally cylindrical shape having an inner diameter equal to said smaller diameter and an outer diameter preferably equal to the outer diameter of cylinder 50 may be force fit thereover. Shade 58 will be provided with an opening 60 at one side. Since shade 58 can be rotated on cylinder 50, the opening 60 permits the reader to rotate the shade and direct light from bulb 54 in any desired direction.

Control of the light can be effected by means such as a simple slide switch 62 mounted within capsule 2, whose movement is controlled by slide-actuating means 64 on the upper side of the capsule as shown in FIG. 6. Wiring for the book-light can be provided by cord 66 entering through an opening in, for example, the base plate 30 of capsule 2, and being suitably connected to the switch 62. From the switch it will pass upwardly through tubular arm 4 where it emerges at the upper end through member 36 and thence through hollow extension 48 into cylinder 50 where it is attached to socket 52.

A book-light made in the manner above described can be formed substantially entirely of lightweight plastic so that the weight of the entire book-light, including the light bulb, can be kept at about 1.5 ounces. Obviously such light weight permits the attachment of the book-light to a hand-held book, etc. without adding any appreciable tiring weight thereto.

In order to maintain low weight portability and size, the lamp bulb is preferably a low voltage light fed from a power supply such as a small portable battery which may be supplied with the book-light or from a regular voltage main through a transformer. The invention, however, is not intended to be limited in this respect.

It will be appreciated that the invention above described fulfills the objectives and embodies the advantages over prior art structures as previously set forth above. The invention is not intended, however, to be limited to the specific details described and illustrated since changes apparent to those skilled in this art are contemplated. It is to be pointed out, moreover, that while the book-light described when used for its intended purpose is preferably small in size and formed of lightweight molded plastic, certain features thereof may well be applicable to portable lights of larger size and greater weight. Accordingly, the scope of this invention is limited only by the claims which follow:

I claim:

1. A portable book-light comprising a base member formed as an enclosed longitudinally extending capsule, a rigid tubular arm, means within said capsule rotatably supporting said tubular arm for transverse movement, a lamp, means mounting said lamp on the other end of said tubular arm, said last means including first means for rotatably supporting said lamp on the end of said arm for circular movement relative thereto, second means attached to said first means for supporting said lamp for vertical movement relative to said arm, and a socket supported from said second means to hold said lamp, and a book-light support extending outwardly from the long side of said capsule, said support comprising a first member having a pair of arms respectively rigidly attached at one end to opposite ends of said capsule, whereby an open area is defined by the two arms on opposite sides with the capsule at one end and the integral connection at the other, and a plate flexibly attached at one end to said capsule and extending outwardly therefrom into said defined open area, said plate extending near its outer end above said arms, whereby the play between said plate and said arms permits the insertion of a flat article therebetween to support the book-light.

2. Portable book-light according to claim 1, in which said plate is bowed upwardly and then downwardly near its outer end to facilitate insertion of said flat article.

3. Portable book-light according to claim 1, in which the means rotatably supporting said tubular arm within said capsule comprises a support in the form of an inverted T having cylindrically shaped arms whose upright stem is inserted within said tubular arm, and bearing means within said capsule rotatably supporting said cylindrically shaped arms.

4. Portable book-light according to claim 3 in combination with means operable upon said bearing means for exerting a variable pressure upon the cylindrically shaped arms of the T, whereby the tubular arm can be held in place.

5. Portable book-light according to claim 4 in which said capsule is formd with an open bottom and in which said last means comprises a base plate attached to and closing the bottom of said capsule.

6. Portable book-light according to claim 2 in which said first member and said flexibly attached plate are unitarily molded with the body of said capsule.

7. Portable book-light according to claim 1, in which said second means includes a pair of arms extending on either side of and pivotally connected to said first means, a stem integrally formed with said arms and projecting outwardly therefrom at right angles thereto, and a cylinder formed integrally at one end with said stem, enclosing and supporting said socket.

8. Portable book-light according to claim 7 in which said cylinder is formed with its opposite end open and of reduced diameter, whereby said lamp may be inserted into said socket, and a shade for said lamp, said shade comprising a cylindrically shaped member whose inner diameter is substantially equal to the reduced diameter of said cylinder, and its outer diameter is equal to the outer diameter of said cylinder, whereby said shade is rotatably supported on said cylinder with a force fit.

9. Portable book-light according to claim 8 in which said cylindrically shaped member is closed at the end opposite to that attached to said cylinder, and is formed with an opening in one wall to permit light from said lamp to be directed therethrough in a direction depending upon the position of said shade relative to the book-light.

10. Portable book-light according to claim 5, in combination with a light switch actuating means mounted on the upper surface of said capsule.

11. Portable book-light according to claim 10, in combination with an on-off switch positioned within said capsule and operable by said actuating means, and wiring for said lamp entering said capsule, passing through said on-off switch extending through said tubular arm and thence through said mounting means to said lamp socket.

12. A portable book light according to claim 1, in which said longitudinally extending capsule is provided with a transverse slot, and in which said tubular arm is rotatably supported for transverse movement in said slot.

* * * * *